US008789651B2

(12) United States Patent
Kawai et al.

(10) Patent No.: US 8,789,651 B2
(45) Date of Patent: Jul. 29, 2014

(54) STRUCTURE HAVING SOUND ABSORPTION CHARACTERISTIC

(75) Inventors: Junichi Kawai, Toyota (JP); Satoshi Mihara, Toyota (JP); Chie Kato, Toyota (JP)

(73) Assignee: Aisin Kako Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/810,031

(22) PCT Filed: May 24, 2011

(86) PCT No.: PCT/JP2011/061881
§ 371 (c)(1),
(2), (4) Date: Jan. 14, 2013

(87) PCT Pub. No.: WO2012/008225
PCT Pub. Date: Jan. 19, 2012

(65) Prior Publication Data

US 2013/0118831 A1 May 16, 2013

(30) Foreign Application Priority Data

Jul. 15, 2010 (JP) ..... 2010-160368

(51) Int. Cl.
*E04B 1/82* (2006.01)

(52) U.S. Cl.
USPC ..... 181/290; 181/284

(58) Field of Classification Search
USPC ..... 181/290, 284
See application file for complete search history.

(56) References Cited

U.S. PATENT DOCUMENTS

| | | | | |
|---|---|---|---|---|
| 4,340,129 | A * | 7/1982 | Salyers | 181/200 |
| 4,487,793 | A * | 12/1984 | Haines et al. | 428/136 |
| 6,202,786 | B1 * | 3/2001 | Pfaffelhuber et al. | 181/286 |
| 6,598,701 | B1 * | 7/2003 | Wood et al. | 181/290 |
| 7,913,813 | B1 * | 3/2011 | Mathur | 181/290 |
| 2007/0102237 | A1 * | 5/2007 | Baig | 181/290 |

FOREIGN PATENT DOCUMENTS

| | | | |
|---|---|---|---|
| JP | 05-059345 | A | 3/1993 |
| JP | 08-260589 | A | 10/1996 |
| JP | 09-281974 | A | 10/1997 |
| JP | 10-121598 | A | 5/1998 |

(Continued)

OTHER PUBLICATIONS

International Search Report of PCT/JP2011/061881 dated Jul. 5, 2011.

*Primary Examiner* — Forrest M Phillips
(74) *Attorney, Agent, or Firm* — Sugrue Mion, PLLC

(57) ABSTRACT

To absorb a noise produced by an external force that generates an audio frequency even if it is applied thereto, and to make it hard to become a noise source to a surrounding area.
It includes a surface layer 20 having microscopic pores 21 formed on a surface 20A, communicating passages 24 communicating with the microscopic pores 21 and a porous layer 10 having sound pores 14 that are formed at an inner part deeper than the surface layer 20 having the microscopic pores 21 formed, communicate with the communicating passage 24 and that have a volume larger than volumes of the microscopic pore 21 formed on the surface 20A and the communicating passage 24. A sound absorption characteristic and/or a sound insulation characteristic is provided by the microscopic pores 21 of the surface 20A, the communicating passages 24 of the porous layer 10, and the sound pores 14 of the porous layer 10. Accordingly, sound absorption control including sound insulation in a predetermined audio frequency band can be achieved and a high sound absorption characteristic can be provided.

3 Claims, 5 Drawing Sheets

(56) References Cited

FOREIGN PATENT DOCUMENTS

| | | | |
|---|---|---|---|
| JP | 2006-265294 | A | 10/2006 |
| JP | 2008-096637 | A | 4/2008 |
| JP | 2009-274711 | A | 11/2009 |
| JP | 2010-014888 | A | 1/2010 |

* cited by examiner

STRUCTURE HAVING SOUND ABSORPTION CHARACTERISTIC

CROSS REFERENCE TO RELATED APPLICATIONS

This application is a National Stage of International Application No. PCT/JP2011/061881 filed May 24, 2011, claiming priority based on Japanese Patent Application No. 2010-160368 filed Jul. 15, 2010, the contents of all of which are incorporated herein by reference in their entirety.

TECHNICAL FIELD

The present invention relates to a structure having an excellent sound absorption characteristic such as a paint used, for example, in an automobile, an electrical product, a mechanical device or the like, and more particularly to a structure having a sound absorption characteristic, in addition to the automobile, for absorbing noise or the like which emanates from a structure such as a part of a tool or a housing thereof, a mechanical structure and a housing thereof, an internal combustion engine having parts that are technically movable, an electric motor, and a transformer, etc. as well as an elastic structure such as a surface or a sound absorbing wall of an auto body of a vehicle like the automobile.

BACKGROUND ART

For example, the structure such as the part of the tool or the housing thereof, the mechanical structure and the housing thereof, the internal combustion engine having parts that are technically movable, the electric motor, and the transformer, etc. as well as the elastic structure such as the surface or the sound absorbing wall of the auto body of the vehicle like the automobile, are generally subjected to vibration. An influence of a sound generated thereon is transmitted via the air as a medium. In particular, restriction on a vehicle exterior noise of automobiles is getting strict, and it is urgent to reduce the vehicle exterior noise (such as an engine noise, a tire noise, and a muffler noise) emitted from the automobile to neighborhoods.

In the future, if an internal combustion engine is switched only to an electric automobile, it naturally releases the engine noise of the internal combustion engine and the noise of the muffler emitting an exhaust gas. However, there is no possibility of being released from the tire noise (road noise) generated by a contact of a tire thereof with a road.

FIG. 5 is a diagram showing generation of the tire noise at present, including not only one which is directly generated by the contact of the tire with the road, but also one which comes outside by being reflected at a wheel housing. On the other hand, in terms of the wheel housing, it reflects not only the tire noise but also part of the engine noise and the exhaust noise and becomes a source of the vehicle exterior noise.

As a countermeasure against such noise, a patent document 1 discloses a structure wherein a foam is filled in a center pillar of an automobile or the like for the purpose of insulating a wind sound or the like and wherein it expands at a high expansion ratio.

For a fender liner for protecting a fender from an impact of a small stone or the like thrown up by a tire, a splash or an impact of muddy water or the like in running on a puddle or the like, a synthetic resin molded plate is generally used. However, the synthetic resin molded plate has low sound absorption capability and has low sound insulation capability, since it creates resonance. Thereby, the engine noise and the road noise are not sufficiently reduced. In addition, the synthetic resin molded plate changes a shock such as an impact of a small stone or the like and a splash or an impact of muddy water into a sound in a frequency range that human can easily hear, so that the fender liner using the synthetic resin has low soundproofing capability. Thus, there is known a fender liner that has a sound absorbing material of a non-woven cloth or the like stuck to a predetermined portion on a surface at a fender side of the fender line to improve soundproofing capability.

Then, a patent document 2 provides a fender line that can mitigate an impact sound of a small stone, earth and sand or the like thrown up by a tire when an automobile is running, a splash noise by a splash or an impact of muddy water or the like in running on a puddle or the like. It can stand a wind pressure even if it is attached to a fender on a front wheel side, since it has a sufficient stiffness. Moreover, even if attached water freezes and accretion of ice is generated, the ice is easily peeled.

In a patent document 3, it is required to increase a thickness of a sound absorbing material in order to increase sound absorption capability in the range not more than a medium frequency, since it is very hard to achieve high sound absorption capability over a wide range of frequencies and since, for example, a porous sound absorbing material has a sound absorption characteristic that is adapted to a high frequency range (about 4000 Hz or more). However, such an increase in the thickness may increase a volume of the sound absorbing material and also increase a weight thereof. Thereby, restriction arises in installation of a sound absorbing structure. In addition, a method for combining the porous sound absorbing material with other film material or other sound absorbing material is effective for changing a sound absorption profile of the porous sound absorbing material to improve sound absorption capability in the medium frequency range. However, it may also lower the sound absorption capability which was originally excellent in the high frequency range. Thus, a thin and lightweight sound absorbing structure, which has excellent sound absorption capability in a medium to high frequency range where sensitivity of human ears is high, is provided. The sound absorbing structure is composed of a composite film sound-absorbing material, which has a plate-like body having a plurality of apertures and a thin film disposed on the plate-like body and which is disposed at a sound source side, and a porous sound absorbing material disposed adjacent to the composite film sound-absorbing material. The thin film has a thickness of 2 μm to 50 μm and an elastic modulus of $1\times10^6$ to $5\times10^9$ Pa.

PRIOR ART DOCUMENT(S)

Patent Document(s)

PATENT DOCUMENT 1: Laid Open (Kokai) Patent Publication No. H05-59345

PATENT DOCUMENT 2: Laid Open (Kokai) Patent Publication No. 2009-274711

PATENT DOCUMENT 3: Laid Open (Kokai) Patent Publication No. 2010-14888

SUMMARY OF THE INVENTION

Problems that the Invention is to Solve

However, in the techniques of the patent document 1, the foam is filled in a center pillar of the automobile or the like for the purpose of insulating the wind sound or the like. Thus, it directly leads to a reduction in a vehicle interior noise. However, an effect is hardly confirmed on prevention of a vehicle exterior noise or influence on an effect to absorb sound.

The patent document 2 provides the fender liner that can mitigate the impact sound of the small stone, earth and sand or the like, which are thrown up by the tire when the automobile is running, and the splash noise by the splash or the impact of the muddy water or the like in running on the puddle or the like and that can stand the wind pressure. However, it is a primary purpose of this fender liner to reduce a chipping noise or a road noise to an interior of the vehicle, since the sound absorption in the wheel housing is handled with a non-woven cloth. Thus, an effect on a vehicle exterior noise cannot be expected.

The patent document 3 provides the sound absorbing structure comprising the composite film sound-absorbing material, which has the plate-like body having the plurality of apertures and the thin film disposed on the plate-like body, and the porous sound absorbing material disposed on the composite film sound-absorbing material. The thin film has the thickness of 2 μm to 50 μm and the elastic modulus of $1\times10^6$ to $5\times10^9$ Pa. Thus, in practice, it is necessary to join the thin film formed on a plane of the plate-like body and the composite film sound-absorbing material formed on the thin film. It also needs an adhesion process of a multilayered structure for sticking them. Thereby, its productivity was poor.

Then, the present invention attempts to solve such problems. It is an object of the present invention to provide a structure having a sound absorption characteristic that absorbs a sound generated by vibration and that makes it hard to become a noise source to a surrounding area.

Means for Solving the Problem

A structure having a sound absorption characteristic according to claim 1 comprises a surface layer having microscopic pores formed on a surface, communicating passages communicating with the microscopic pores, and sound pores of a porous layer that are formed at an interior deeper than the surface layer and that have a volume larger than volumes of the microscopic pores and the communicating passages. A part of the sound pores communicate with the microscopic pores through the communicating passages. A sound absorption characteristic and/or a sound insulation characteristic is/are provided by the microscopic pores of the surface layer, the communicating passages and the sound pores.

Here, the microscopic pore formed on the surface layer, the communicating passage communicating with the microscopic pore and the sound pore of the porous layer which is formed in the porous layer at an inside deeper than the surface layer having the microscopic pore formed thereon, which communicates with the communicating passage and which has a volume larger than volumes of the microscopic pore formed in the surface layer and the communicating passage, specify that the volume of the individual sound pores is large when individual ones are compared among the sum of the volume formed by the microscopic pores formed in the surface layer and the volume of the communicating passages communicating with the microscopic pores and the volume of the sound pores at the porous layer. The volume of the sound pores is not fixed but they have a plurality of kinds at random, since the sound pores are formed in the porous layer. Here, it does not limit each of the volumes of the microscopic pores and the communicating passages. It may be sufficient if the both exist together as one body. In this sense, the surface layer may have a thickness close to zero if it has a surface. Also, the communication passage may have a length close to zero. In this case, the length of the communicating passage, which is close to zero, means a minute space formed on a contact surface of the microscopic pore and the sound pore.

The microscopic pore, which is formed on the above-described surface layer, and the random sound pore, which is formed at the interior than the above-described surface and which is larger than the microscopic pore of the surface, may be formed of a foam of a single synthetic resin, too. It may be formed in such a manner that a synthetic resin layer of random sound pores that are larger than the microscopic pores of the surface are laid on the microscopic pores bored on a surface of a specific board, too. In addition, it may be also constructed in such a manner that a film or a thin metal plate having predetermined microscopic pores is laid on the layer of the large sound pores. In any case, any structure may be adopted as long as porous sound pores are formed inside the structure having a sound absorption characteristic of the present invention, the microscopic pores and the internal sound pores partially communicate and the sound pore is larger than the microscopic pore.

A foamable synthetic resin may be used for the microscopic pore of the surface layer and the porous layer. The synthetic resin includes a thermoplastic resin such as a polyethylene resin, a polypropylene resin, and a vinyl chloride resin or a thermosetting resin such as an epoxy resin, a urethane resin, an acrylic resin, and a phenolic resin. As a foaming agent for foaming the synthetic resin, a generally used foaming agent may be used such as an organic foaming agent, an inorganic foaming agent, microcapsules, a hydrated inorganic filler or the like.

Moreover, the structure comprising the microscopic pores of the surface layer, the communicating passages of the porous layer and the sound pores of the porous layer that provide the above-described sound absorption characteristic and/or the sound insulation characteristic may be as follows. For example, a Helmholtz resonator may be formed by the microscopic pores of the surface layer, the communicating passages of the porous layer, and the sound pores of the porous layer. A film resonator may be formed by the microscopic pores of the surface layer and the sound pores. In addition, a vibration damping body, which is created by interaction of air vibration by a porous elastic body and an elastic body, may be formed by the sound pores of the porous layer.

In addition, the microscopic pores formed on the surface of the surface layer and the sound pores formed in the porous layer are formed on the surface layer and the porous layer, respectively. However, the microscopic pores and the communicating passages communicating with the sound pores serve even if they are formed in any of the surface layer and/or the porous layer.

In a structure having a sound absorption characteristic according to claim 2, the surface layer and the porous layer are formed of foamable synthetic resin compositions.

Here, the surface layer and the porous layer are formed of foamable synthetic resin compositions. It means that the surface layer and the porous layer are formed by foaming one kind or plural kinds of synthetic resin compositions. It shows that the surface layer and the porous layer are formed in an integral manner or a separate manner.

In sound pores of a structure having a sound absorption characteristic according to claim 3, at least a part of the sound pores communicates with each other. Thus, the sound pores of the porous layer have an increase in volume, and a sound absorption characteristic can be provided up to a low frequency.

Here, at least a part of the sound pores communicates with each other. It does not mean that all the sound pores communicate with each other. It means that a plurality of sound pores has two or three sound pores communicating with each other.

In a structure having a sound absorption characteristic according to claim 4, the microscopic pores of the surface layer, the communicating passages and the sound pores provide a sound absorption characteristic in a frequency band including at least 1000 Hz in an audible frequency range of a human being.

Here, a sound absorption capability in a frequency band includes at least 1000 Hz in the audible frequency range. It means that, since a frequency of around 1000 Hz is especially sensitive to a human hearing in a range of audible frequencies of the human being from 20 Hz to 20000 Hz, the sound absorption capability is set in a frequency band including at least 1000 Hz.

In a structure having a sound absorption characteristic according to claim 5, the surface layer with the microscopic pores formed thereon has a density higher than that of the porous layer. More specifically, the microscopic pore formed on the surface layer has a small diameter and a large number of pores thereof need to be arranged. On the other hand, the sound pore at the porous layer side preferably has a large diameter, so the surface layer with the microscopic pores formed thereon has a density higher than that of the porous layer having the sound pores.

In a structure having a sound absorption characteristic according to the invention of claim 6, the microscopic pores formed on the surface have an area ratio of pores to the surface set at 0.1% to 10% and a diameter of the microscopic pores of the surface set at 1 μm to 300 μm.

Here, the microscopic pores formed on the surface, which have an area ratio of pores to the surface of 0.1% to 10% and a diameter of the microscopic pores on the surface of 1 μm to 300 μm, maintain mechanical strength of a member forming the surface. The diameter of the microscopic pores on the surface is set within a range of 1 μm to 300 μm to make it possible to absorb the audio frequency which is especially sensitive to the human hearing. In addition, the area ratio of the pores to the surface means a proportion of voids on the surface, which is formed by the microscopic pores, to a fixed surface area. The diameter of the microscopic pores of the surface means a diameter when the void on the surface is regarded as a circle.

In a structure having a sound absorption characteristic according to claim 7, a foamable synthetic resin composition is a liquid material. The liquid material is applied to an object to be coated, and then is formed by foaming.

It means that the structure having a sound absorption characteristic is formed by providing foaming by heat (reaction heat) generated by a heating process or a reaction of materials after applying the foamable synthetic resin composition to the object to be coated. The foamable resin may be a thermosetting resin or a thermoplastic resin.

Effects of the Invention

The structure having the sound absorption characteristic according to the invention of claim 1 comprises the surface layer having the microscopic pores formed on the surface, the communicating passages communicating with the microscopic pores, and the sound pores of the porous layer that are formed at the interior deeper than the surface layer and that have the volume larger than the volumes of the microscopic pores and the communicating passages. A part of the sound pores communicate with the microscopic pores through the communicating passages. The sound absorption characteristic and/or the sound insulation characteristic is/are provided by the microscopic pores of the surface layer, the communicating passages and the sound pores.

Accordingly, it is possible to increase a flow resistance of the air at a surface layer portion that flows through the microscopic pore formed on the surface to the communicating passage, while decreasing a flow resistance of the air flowing through the sound pore leading thereto can be lowered. Thus, there is formed a sound absorbing mechanism or a Helmholtz resonator that takes propagation of sound generated by vibration into the interior of the structure having the sound absorption characteristic to attenuate it. A portion of the sound pore having a large volume is directly close to the surface layer without communicating with the microscopic pore and the communicating passage. At such portion, if the sound generated by vibration is propagated thereto, the vibration of the propagated sound is absorbed by resonance oscillation of the surface layer. Then, it also attenuates the sound propagation. The sound pores are formed of the porous layer. Thus, when the propagated sound moves through the porous layer, the porous layer resonates. This resonation also attenuates the sound. Moreover, the sound pores of the porous layer have a plurality of random volumes. Consequently, a sound absorption (sound insulation) in a wide range of frequencies can be achieved, and a high sound absorption characteristic can be provided. In addition, it has the structure that changes and attenuates the flow resistance of the air from the surface to the interior by increasing the flow resistance of the air from the microscopic pores of the surface to the interior of the surface layer, while lowering the flow resistance of the air from the surface layer to the internal sound pores. Thus, a noise taken into the sound pores can be attenuated without being reflected.

Consequently, there is provided a structure having a sound absorption characteristic that absorbs or interferes with (resonates with) the sound (noise) generated by vibration, thereby being able to prevent diffusion of noise to a surrounding area.

The structure having a sound absorption characteristic according to the invention of claim 2 comprises the surface layer and the porous layer that are formed of the foamable synthetic resin compositions. Thus, in addition to the effects recited in claim 1, they can be formed in an integral manner in case synthetic resins made of the same material are used. In particular, if the foamable synthetic resin composition is a liquid material, the structure having the sound absorption characteristic can be produced by applying the liquid material to an object to be coated and foaming it. Thus, it does not take time and effort for production.

In the structure having the sound absorption characteristic according to the invention of claim 3 comprising the microscopic pores of the surface layer, the communicating passages of the porous layer and the sound pores of the porous layer, at least a part of the sound pores communicates with each other. Thus, in addition to the effects of claim 1 or claim 2, the sound pores of the porous layer have an increase in volume and the sound absorption characteristic can be provided up to the low frequency. An effect of the sound absorption characteristic can be also obtained with respect to a low frequency noise.

The structure having the sound absorption characteristic according to the invention of claim 4 has the sound absorption capability provided in the frequency band including at least 1000 Hz in the audible frequency range of the human being. Thus, in addition to the effects recited in claim 1 to claim 3, it is possible to prevent the noise from diffusing to a surrounding area, since the sound absorption (sound insulation) can be performed in the frequency band that the human can easily hear.

In the structure having the sound absorption characteristic according to the invention of claim 5, the surface layer with the microscopic pores formed thereon has a density higher than that of the porous layer. Thus, in addition to the effects recited in one of claim 1 to claim 4, the mechanical strength of the surface layer can be maintained. The vibration (noise) by the sound propagation can be effectively absorbed and insulated for a long period of time. Moreover, the sound pores grow larger with a decrease in the density of the porous layer, so that the sound having a low audio frequency can be absorbed and insulated.

In the structure having the sound absorption characteristic according to the invention of claim 6, the microscopic pores formed on the surface has the area ratio of the pores to the surface of 0.1% to 10% and the diameter of pores of the surface of 1 μm to 300 μm. Thus, in addition to the effects recited in one of claim 1 to claim 5, the mechanical strength of the surface layer can be more certainly maintained. The vibration (noise) by sound propagation can be effectively absorbed and insulated for a long period of time.

In the structure having the sound absorption characteristic according to the invention of claim 7, the foamable synthetic resin composition is the liquid material. The foamable synthetic resin composition, which is the liquid material, is applied to the object to be coated and then is formed by foaming. Thus, in addition to the effects recited in one of claim 2 to claim 6, an arbitrary coating shape can be created and an automatic coating process can be performed using a coating device such as a coating robot depending on a shape adjustment after coating or ease in handling or the like. In addition, the structure having the sound absorption characteristic, which increases the flow resistance of the air at the surface side and which lowers the flow resistance of the air at the interior can be practiced in the form of a liquid material (paint). Thereby, in a vehicle, it can be utilized as a liquid thermosetting coating-type sound absorbing material for an undercoat, a pillar filling or a vehicle interior paint. It is not necessary to form it by putting it in a closed mold for a specific molding, so that a film can be formed in an open mold.

BRIEF DESCRIPTION OF THE DRAWINGS

[FIG.1] FIG. 1 is an explanatory drawing showing a basic principle on a structure having a sound absorption characteristic of an embodiment of the present invention.

FIG. 2 is an electron micrograph of a surface of the structure having a sound absorption characteristic of the embodiment of the present invention.

FIG. 3 is an electron micrograph of a cross section of the structure having a sound absorption characteristic of the embodiment of the present invention.

FIG. 4 is a graph showing a sound absorption characteristic of the structure having a sound absorption characteristic of the embodiment of the present invention as compared with other material.

FIG. 5 is an explanatory diagram showing a generation status of noise produced by a tire of an automobile.

EXPLANATION OF CODES

Figure 1A:
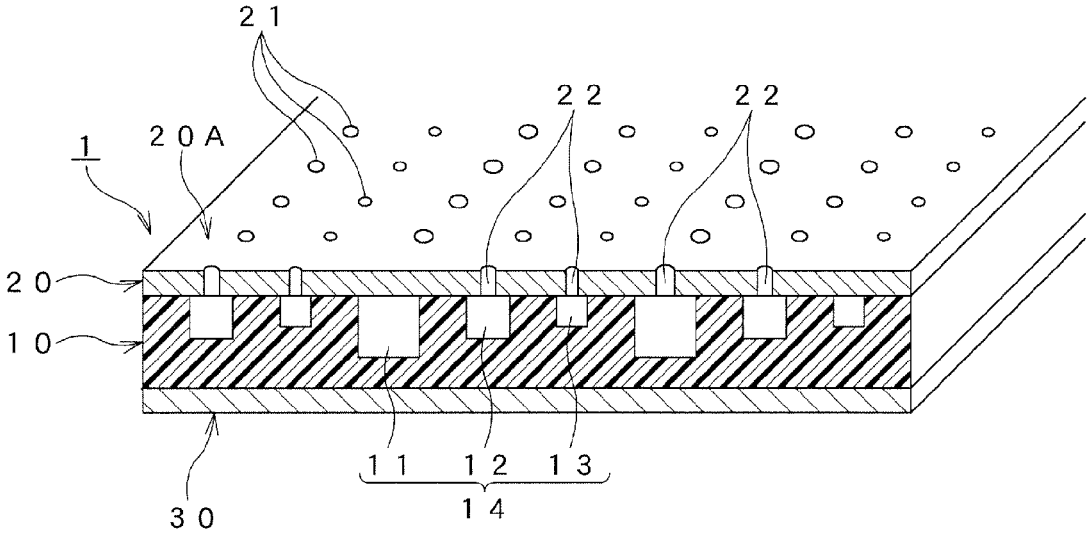
FIG. 1A is a pattern diagram illustrating the basic principle.

10: porous layer
14: sound pore
16: connecting pore
20: surface layer
20A: surface
21: microscopic pore
22: communicating passage
30: base

MODE(S) FOR EMBODYING THE INVENTION

Embodiments of the present invention are described hereafter referring to the drawings.

In the embodiments, the same symbols and the same codes define the same or equivalent parts and functions. Therefore, their redundant description is omitted here.

[Basic Principle]

First, FIG. 1 is used to describe a basic principle to practice a structure having a sound absorption characteristic of the present invention using a pattern diagram.

In FIG. 1A, a porous layer 10 has sound pores 14 having a plurality of random volumes. Here, for explanation, the sound pore 14 is described as a large pore 11, a medium pore 12, and a small pore 13.

A surface layer 20 is present outside the porous layer 10 with the sound pores 14 such that it is contacted to the porous layer 10. The surface layer 20 has microscopic pores 21 provided on a surface 20A thereof. The microscopic pore 21 is not limited to a circular shape, but the circular shape is applied for explanation. A diameter of the microscopic pore 21 is smaller than a diameter of the sound pore 14 having a plurality of random volumes. More specifically, it means that an average diameter obtained by arithmetically averaging random microscopic pores 21 is smaller than an average diameter obtained by arithmetically averaging random sound pores 14.

Figure 1B:
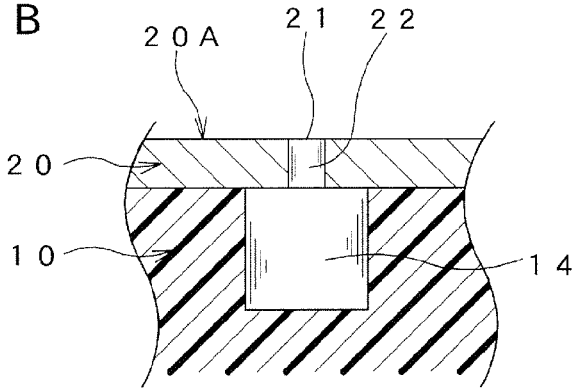
FIG. 1B is a pattern diagram illustrating a basic structure of a Helmholtz resonator.
Figure 1C:
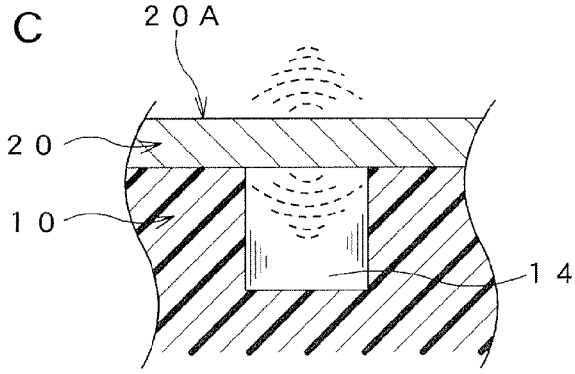
FIG. 1C is a pattern diagram of a pore which does not constitute the Helmholtz resonator.

As seen from FIGS. 1A, 1B, and 1C, the sound pores 14 of the porous layer 10 are located at an inside deeper than the surface 20A of a structure 1 having a sound absorption characteristic. A part of the sound pores 14 communicate with the microscopic pores 21 through cylindrically-shaped communicating passages 22. That is, a part of the sound pores 14 communicate with an outside of the structure 1 having the sound absorption characteristic by the cylindrically-shaped communication passages 22 via the microscopic pores 21. Remaining sound pores 14 form closed spaces connected to the surface layer 20. The sound pore 14, which is shown as the large pore 11, the medium pore 12 or the small pore 13 to show the plurality of random volumes, has a volume larger than a volume obtained by adding volumes of the microscopic pore 21 and the communicating passage 22 leading thereto.

Here, the microscopic pore 21 is formed into a circular shape, and the communicating passage 22 leading thereto is formed into a cylindrical shape. However, a structure may be formed such that the microscopic pore 21 is formed into a cylindrical shape and the communicating passage 22 is formed into a circular shape, too. In addition, the large pore 11, the medium pore 12 and the small pore 13 of the sound pore 14 are made into a cylindrically-shaped space for explanation. However, in the practice of the invention, it is not a prerequisite of the sound pores 14 to become uniform pores. It is a prerequisite of them to have various sizes such as the large pore 11, the medium pore 12, and the small pore 13. The shape thereof is not limited to a fixed shape such as a cylindrical shape, either. There may be various shapes mixed. Furthermore, it may be an irregular shape. Accordingly, the sound pore 14 of the porous layer 10 is not limited in shape and size if it is larger than the microscopic pore 21 and the communicating passage 22. A cotton-like one such as a felt or a fiber-like one may be used, for example. Moreover, the microscopic pore 21 and the communicating passage 22 are also not limited in shape and size if they are smaller than the sound pore 14. Here, an idea of the circular shape is a concept of no thickness (which may be rephrased as a width or a length). However, the circular microscopic pore 21 or the circular communicating passage 22 practically has a thickness from one that is very close to zero to one that has a certain degree of thickness.

Next, a sound absorption characteristic is described using FIGS. 1B and 1C.

If a sound (noise) generated by vibration is propagated to the structure 1 having the sound absorption characteristic through the air, as shown in FIG. 1B, a part of the sound makes the air in the microscopic pore 21 vibrate. At this time, the diameters of the microscopic pore 21 and the communicating passage 22 are smaller than the diameter of the sound pore 14. Moreover, the volumes of the microscopic pore 21 and the communicating passage 22 are smaller than the volume of the sound pore 14. That is, it means that ventilation to an inside of the sound pore 14 passes through the microscopic pore 21 and the communicating passage 22 where the ventilation is hard (flow resistance is high) as compared with the sound pore 14. If the sound is propagated to the microscopic pore 21 where the ventilation is hard, resonance is created by interaction of spaces of the microscopic pore 21 and the communicating passage 22 with a space inside the sound pore 14. Consequently, among propagated sounds, a specific frequency, at which the resonance was created, is attenuated (sound is absorbed and insulated).

Moreover, as shown in FIG. 1C, the sound remaining after propagation to the structure 1 having the sound absorption characteristic resonates the surface layer 20 contacted to the sound pore 14. This resonance also attenuates a specific frequency of the propagated sound (sound is absorbed and insulated).

The sound pores 14 are a foamed porous layer 10. Accordingly, a part of the sound pores 14 communicate with the sound pores 14 with each other. Thus, the sound propagated to the sound pore 14 is further propagated to another sound pore 14. In this case, energy of sound propagation is reduced by flow resistance (ventilation resistance) of the air inside the porous layer 10. Moreover, the porous layer 10 vibrates by the propagated sound. This vibration also attenuates a frequency (sound is absorbed and insulated).

At this time, a sound absorption frequency differs between a sound absorption by resonance by a space such as the microscopic pore 21 and a sound absorption by resonance of the surface layer 20. Moreover, a frequency of sound absorption in the porous layer 10 also differs therefrom. Accordingly, a wide range of frequencies of sound included in a noise is absorbed and an effective sound absorption characteristic can be obtained.

Moreover, in the present invention, there is provided a structure having a sound absorption characteristic that can absorb a wider range of frequencies, since the sound pores 14 have volumes of various sizes. Of course, a frequency of attenuating sound can be controlled by adjusting the size (volume) of the sound pore 14 into a predetermined range, so that a desired sound absorption characteristic can be obtained. In case of the present invention, in order to reduce the noise produced by an automobile or the like, the microscopic pore 21 of the surface layer 20 is adjusted to be smaller than the sound pore 14 so as to create a space resonance at the surface layer 20 and the sound pore 14 and to create a film resonance of the surface layer 20, thereby improving a sound absorption characteristic in a medium frequency range that is an audible frequency range of the human being.

The microscopic pore 21 formed on the surface 20A of the surface layer 20 and the sound pore 14 formed in the porous layer 10 are formed on the surface layer 20 and on the porous layer 10 in FIG. 1. However, in the practice of the present invention, the communicating passages 22 communicating with the microscopic pores 21 and the sound pores 14 may be formed in any of the surface layer 20 and/or in the porous layer 10.

[First Embodiment]

Figure 2:
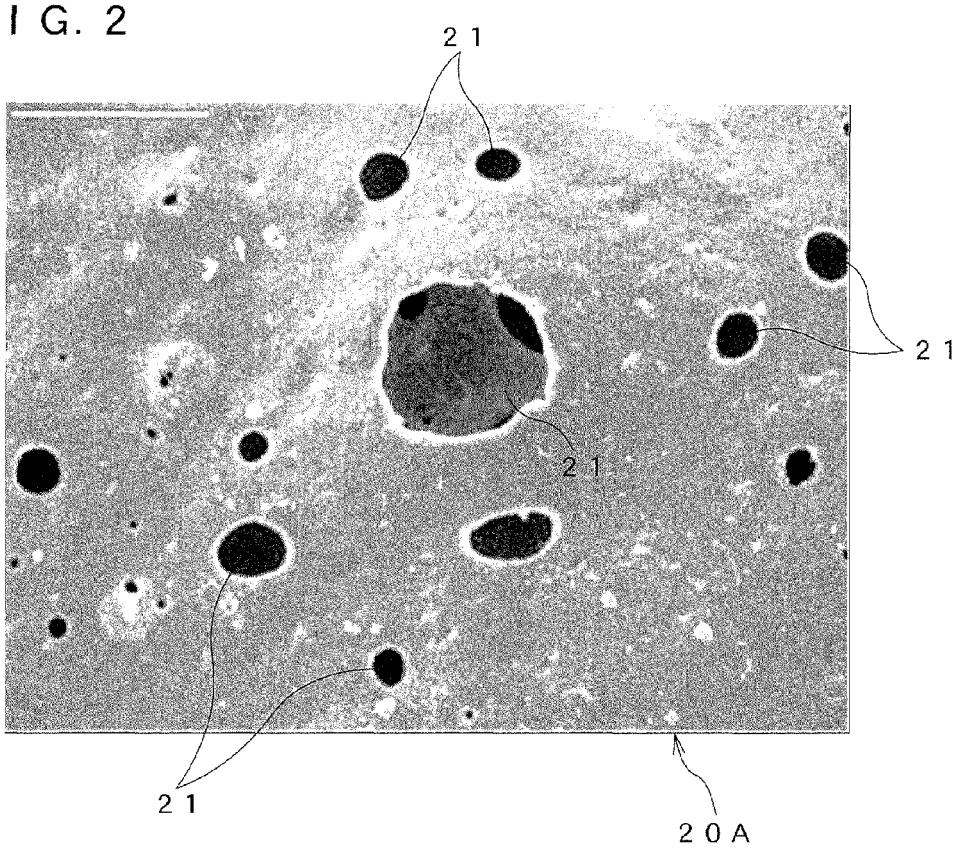
[FIG.2]
Figure 3:
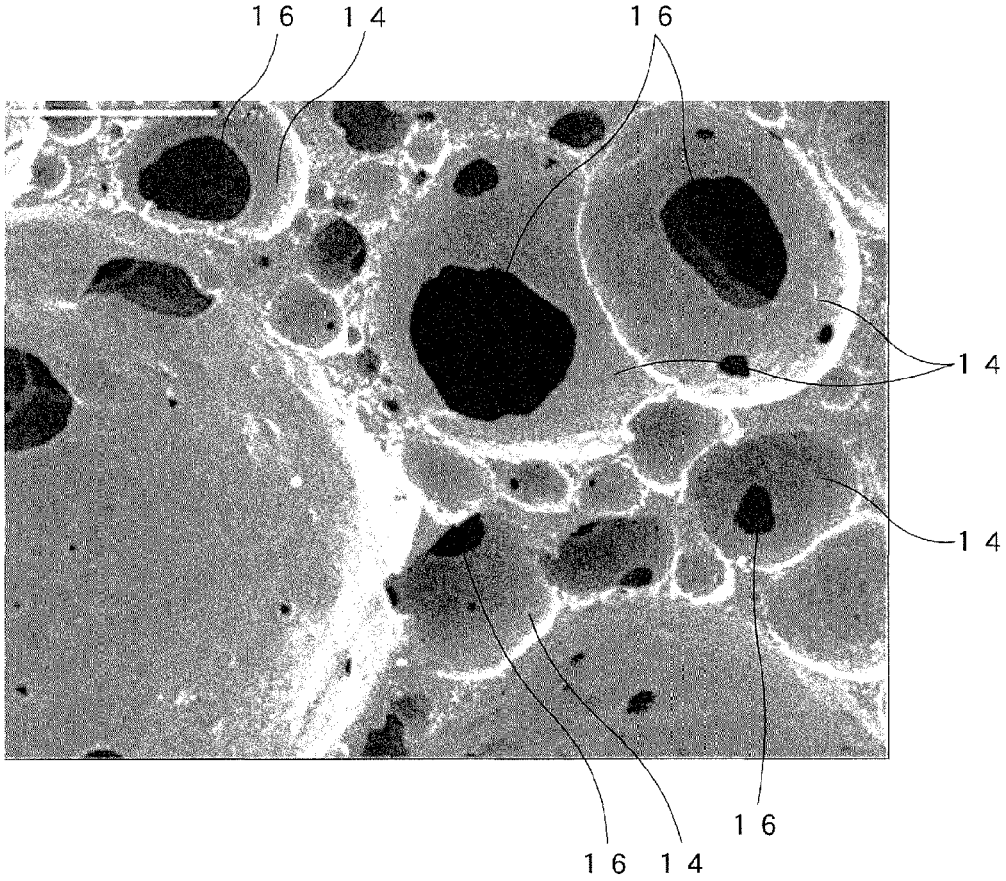
[FIG.3]

Next, a structure 1 having a sound absorption characteristic in a first embodiment of the present invention is described using FIGS. 2 and 3.

The structure 1 having the sound absorption characteristic in the first embodiment of the present invention contains a synthetic resin as a main component and is obtained by heating and foaming a composition mixing it with a foaming agent. This is a foamable synthetic resin composition. To describe in more detail, a foaming agent is blended in a one-pack urethane resin as a synthetic resin, which uses an isocyanate for a blocked urethane resin and, if necessary, an additive such as a surfactant or a filler such as calcium carbonate is added and mixed, thereby making the composition. Accordingly, the formable synthetic resin composition is a liquid material. The prepared composition is applied to a portion (object to be coated) desired to reduce noise, for example, a fender liner constituting a wheel housing of an automobile or the like, using a coating device such as a coating robot. Then, curing of the one-pack urethane resin proceeds by performing a heat treatment. Moreover, the foaming agent included in the composition is thermally decomposed to generate foaming gas. Finally, a foaming structure of a urethane resin (structure 1 having a sound absorption characteristic) is completed, which has a state of a surface shown in FIG. 2 and a cross section shown in FIG. 3. It is a foam of the urethane resin, so that an inner portion of the structure 1 having the sound absorption characteristic is formed of a porous layer having elasticity.

Here, the isocyanate used in the blocked urethane resin is preferably TDI (tolylene diisocyanate) or MDI (methylene diphenyl diisocyanate) that is suitable for forming a porous layer having a high effect to absorb sound. Particularly, TDI is preferable. An additive amount thereof is 3 percent by weight to 90 percent by weight, more preferably 5 percent by weight to 40 percent by weight. A molecular weight of the blocked urethane resin is preferably 1000 to 30000 at weight average molecular weight Mw in order to contain a foaming gas therein. It is more preferably 5000 to 20000. If the weight average molecular weight Mw is below 1000, a decomposition gas cannot be trapped at the time of curing. On the other hand, if it is over 30000, it is hard to obtain a structure having a high effect to absorb sound. In addition, a normal one such as an organic foaming agent and an inorganic foaming agent is applicable as the foaming agent. One kind thereof or a combination thereof is selected for use depending on a temperature at the heat treatment. In the present embodiment, oxybis benzene sulfonyl hydrazide (OBSH) is used. An additive amount thereof is preferably 3% to 30% relative to a weight of the urethane resin, more preferably 5% to 20%. In addition, a foaming agent may be added as needed.

As a heat source of the heat treatment, in case it is used in an automobile for example, a drying line of a coating process may be used. Accordingly, an existing equipment may be utilized and it is not necessary to prepare a new equipment for heating. The structure 1 having the sound absorption characteristic in the present embodiment forms a structure 1 having a sound absorption characteristic that has a sound absorbing structure by heating and foaming the composition containing the foaming agent after coating it to a portion (object to be coated) desired to absorb sound (insulate sound). Thereby, it is not necessary to mold a shape in advance. Moreover, the structure is formed after applying the composition. Consequently, it becomes a shape that fits to any-shaped objects to be coated. Thus, it has an advantage that it is not limited in the shape. Thereby, it can be used not only at an outside of a vehicle body such as a fender liner but also at an inside of the vehicle body or at an inside of a framework of the vehicle body such as a pillar.

In the present embodiment, decomposition (foaming) of the foaming agent is performed by heating from the outside. However, when a synthetic resin using a synthetic resin that generates heat by reaction of two-pack urethane or the like is used, the foaming agent may be also foamed by this reaction heat.

As seen from the state of the surface of the structure 1 having the sound absorption characteristic shown in FIG. 2 and the state of the cross section inside the structure 1 having the sound absorption characteristic shown in FIG. 3, pores opened on a surface 20A are smaller than pores of the cross section that are opened at the inside of the structure 1 having the sound absorption characteristic. Thus, they are microscopic pores 21. Moreover, diameters thereof are distributed in a range of 1 μm to 300 μm obtained from an image measurement with an electron microscope. The pores of the cross section that are opened at the inside of the structure 1 having the sound absorption characteristic, are sound pores 14, since they are porous and have pores larger than the microscopic pores 21. In addition, it was found from an image measurement with an electron microscope that the sound pores 14 were pores having a size of 300 μm or more. Here, the microscopic pores 21 and the sound pores 14 are not formed into a perfect circle but formed into a distorted circle. Thus, calculation of diameters is carried out such that a largest width of the pores is regarded as a diameter and such that all the pores are included in that diameter.

The sound pores 14 formed inside the structure 1 having the sound absorption characteristic are formed almost over an entire area of the inside thereof. On the other hand, the microscopic pores 21 are formed on a part of the surface 20A. An area ratio of pores to the surface at this time was within a range of 0.1% to 10% from an image measurement with an electron microscope. As seen from FIG. 2, the surface observed with the electronic microscope is a part of the surface of the structure 1 having the sound absorption characteristic, which may be measured with the electronic microscope. Therefore, the way in which the microscopic pores 21 appear varies depending on a portion to be observed. Thus, the measurement is performed by changing some of measurement portions of the surface 20A of the structure 1 having the sound absorption characteristic. It is also the same in the above-described measurement of the diameter of the sound pores 14. Here, the area ratio of the pores to the surface is a proportion of a total area of all of the microscopic pores 21 included in the surface which is observable with the electronic microscope (total area of an observed surface). It is understood from the area ratio of the pores to the surface that all the sound pores 14 formed inside the structure 1 having the sound absorption characteristic do not communicate with the microscopic pores 21 of the surface and that part of them are covered with the surface layer 20 without the microscopic pore 21. Accordingly, as described in the above-described pattern diagram, it is possible to perform a sound absorption (sound insulation resonance) by spaces different in size and a sound absorption (film resonance) by vibration of the surface layer film provided by the surface layer 20 in the present embodiment.

As described above, the area ratio of the pores to the surface is within the range of 0.1% to 10% as described above. Thus, the density of the surface layer 20 is higher than a density of the sound pores 14 that are formed at the inside of the structure 1 having the sound absorption characteristic almost over the entire area thereof, i.e. the porous layer 10. Here, a communicating passage 22 is not clear from the electron micrographs of FIGS. 2 and 3. However, a passage of the decomposition gas from the sound pore 14 to the microscopic pore 21 becomes the communicating passage 22, since the microscopic pore 21 and the sound pore 14 are formed by the decomposition gas of the foaming agent. Sizes thereof can be controlled by characteristics of the foaming agent, including its kind, quantity and curing of a resin or a temperature in heating. Moreover, it is understood from FIG. 3 that the sound pore 14 has a connecting pore 16 opened that connects to another sound pore 14. It means that bubbles formed by the decomposition gas at the time of foaming grow larger and become interconnected cells when the bubbles contact and communicate with each other. The porous layer 10 is formed of the interconnected cells. Moreover, a part of the interconnected cells reach the surface to form pores that become microscopic pores 21. As described above, an effect of a space resonance increases by connecting the mutual sound pores 14 with the connecting pore 16. Moreover, a resonance effect by the porous layer 10 is added, too. Thereby, a more effective sound absorption characteristic can be obtained.

In the present embodiment, the structure 1 having the sound absorption characteristic is formed by foaming the one-pack urethane. However, it is not limited to the one-pack urethane if it is a resin capable of forming a structure, by foaming, that has microscopic pores 21, communicating passages 22, and sound pores 14 of a porous layer 10 as shown in the present invention. A thermosetting resin such as two-pack urethane, an epoxy resin and a phenolic resin or a thermoplastic resin such as a vinyl chloride resin, a polyethylene resin and a polypropylene resin may be also used. In particular, if the foam by the synthetic resin has elasticity as in the present embodiment, walls of the surface layer 20 and the porous layer 10 easily vibrate by resonance depending on a frequency of the propagated sound. With this resonance, a sound propagation energy is used for resonance energy, so that the sound propagation is attenuated. Thereby, a favorable sound absorption characteristic is shown.

In the present embodiment, a coating-type structure 1 having a sound absorption characteristic is provided by coating the composition containing the synthetic resin such as the thermosetting resin or the thermoplastic resin as a main component on a required portion (object to be coated) of a noise source or to the vicinity thereof, and then the composition is foamed to form the structure. Thus, time and effort is reduced in molding or an attachment work to a required portion as in a conventional molded article such as a felt. Moreover, an attachment portion is free from restriction on a shape thereof, since the structure is formed after coating. However, it may be also attached after molding as in the conventional article. In the present embodiment, the structure 1 having the sound absorption characteristic is formed of one composition (material). However, the porous layer 10 and the surface layer 20 may be also formed of separate structures. In this case, the structure 1 having the sound absorption characteristic may be formed by making the porous layer 10 from a foamable resin and joining it to a film or the like having the surface layer 20 of the processed microscopic pores 21 with an adhesive or the like. As for processing of the microscopic pores 21, a cutting work such as a laser machining or an electric discharge machining may be used. The film or the like is not limited to a synthetic resin. A metal thin film or the like may be also used.

Figure 4:
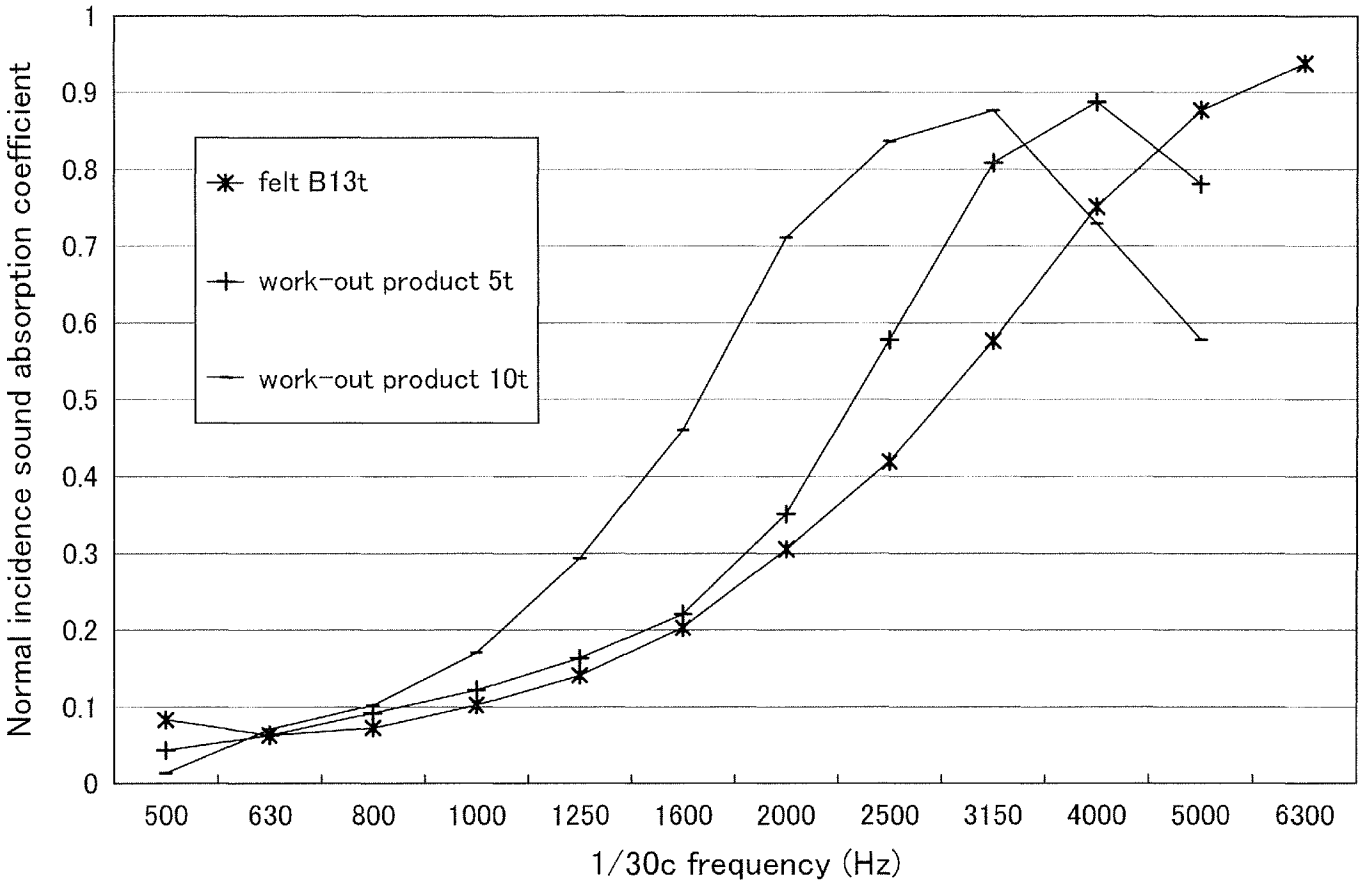
[FIG.4]
Figure 5:
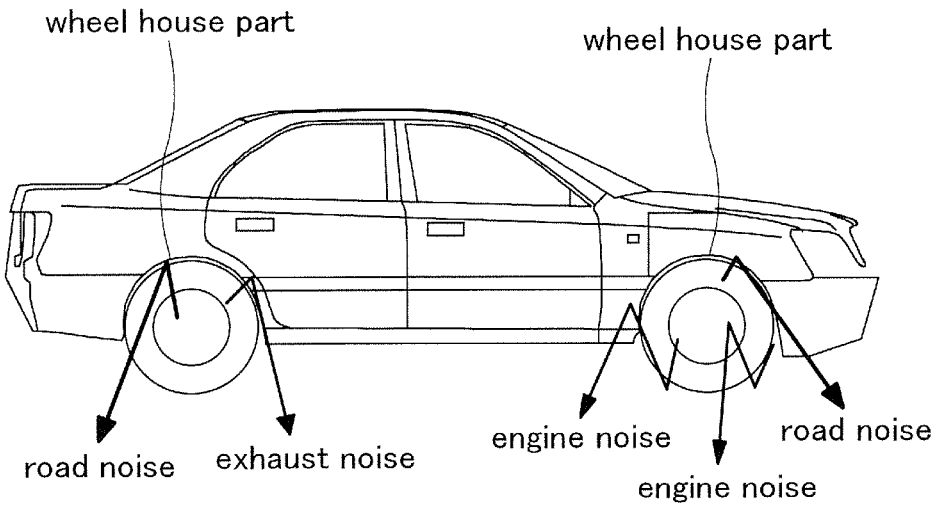
[FIG.5]

Next, a sound absorption characteristic of the structure 1 having a sound absorption characteristic in the present embodiment is described based on FIG. 4. A method for evaluating the sound absorption characteristic was according to JIS A 1405-2.

As seen from FIG. 4, it is confirmed that a work-out product of the present embodiment has an excellent sound absorption characteristic even if it is a thin film, as compared with the conventional felt.

In addition, even though its thickness is 5 mm, it shows a sound absorption characteristic higher than that of the felt in an audible range of the human being of 800 Hz or more. On the other hand, if it has a thickness of 10 mm thinner than that of the felt, which is 13 mm, a remarkable effect to absorb sound is shown at 1000 Hz or more. Here, a sound absorption coefficient of the felt is better at 5000 Hz or more. However, it is out of a center noise of a vehicle interior sound and a vehicle exterior sound such as an engine noise and a road noise. It tends to be away from characteristics of a frequency that the human can easily hear. Thus, it is clear that the work-out product St (5 mm in thickness) and the work-out product 10t (10 mm in thickness) have excellent characteristics.

[Second Embodiment]

A porous layer 10 of the present embodiment is provided as follows. An aqueous dispersion of polytetrafluoroethylene (that is hereafter simply referred to as "PTFE") made by agitating a surfactant and the water is prepared. The aqueous dispersion is coated on a base 30, which is a fender liner constituting a wheel housing of a vehicle, by known coating means such as spraying using a coating device such as a coating robot. A heat treatment is performed at a temperature of about 250 degrees centigrade to 350 degrees centigrade in order to evaporate and remove moisture and the surfactant in the coated aqueous dispersion. The base 30 that is the fender line is subjected to the heat treatment at a temperature of about 250 degrees centigrade to 350 degrees centigrade, since it is made of an iron. However, in case it is made of a resin, it is necessary to set it depending on a heating temperature and a treatment speed.

In addition, PTFE has a high melting point and originally does not melt to a core thereof even if it reaches the melting point. Thus, PTFE becomes a mass of net-shaped particles when it is viewed microscopically and an inner portion thereof has a net shape. A communicating passage 22 is naturally formed by contraction of a melted portion between the PTFE particles.

In particular, when PTFE is cooled, a surface thereof is solidified first. The inner portion thereof, especially a base side 30, is gradually solidified, since the heat is accumulated in the base 30 itself. Thereby, cavities or sound pores 14 are also formed in the inner portion. The sound pore 14 becomes larger than a diameter of a microscopic pore 21 such as a large pore 11, a medium pore 12, a small pore 13 and so on depending on a place, since it is naturally formed.

At this time, the present embodiment is constructed of microscopic pores 21 formed on a surface 20A of a porous layer 10 of the microscopic pores 21, which is an upper layer of the porous layer 10, communicating passages 22 communicating with the microscopic pores 21 and sound pores 14 of random sizes, which are formed at an inner part deeper than the surface 20A and which communicate with the communicating passages 22 and which have a volume larger than volumes of the microscopic pore 21 formed on the surface 20A and the microscopic pore 21.

It is generally necessary to determine sizes of the microscopic pore 21 and the sound pore 14 formed at the inside thereof depending on a frequency band which is intended to eliminate a sound. Thus, the microscopic pores 21 and the sound pores 14 are determined by a firing temperature of PTFE, a surfactant or the like. Or it can be also handled by adding to PTFE a melt-type (melting type) fluororesin other than PTFE, for example, such as a tetrafluoroethylene-hexafluoropropylene copolymer (FEP).

In particular, if the sound pores 14 are formed of the net as in PTFE, it becomes an effective sound absorbing member, since it makes a piece of the net inside the sound pores 14 of a Helmholtz resonator mechanically vibrate and consumes a voice as heat energy.

As described above, the resonance structure is constructed of the microscopic pores 21 formed on the surface 20A of the surface layer 20 formed on the upper layer of the porous layer 10, the communicating passages 22 communicating with the microscopic pores 21 and the sound pores 14 of a plurality kinds of volumes that are formed at the inner part deeper than the surface 20A having the microscopic pores 21 formed thereon and that communicates with a communicating passage which is not shown in the figure and that have a volume larger than the volumes of the microscopic pore 21 formed on the surface 20A and the communicating passage which is not shown in the figure. A value of a flow resistance of the air at the surface 20A is increased. A flow resistance of the air in the sound pore 14 formed at the inside of the porous layer 10 deeper than the surface 20A is lowered.

[Third Embodiment]

Moreover, a crosslinkable resin can be formed in the same manner, too.

The present third embodiment forms a porous layer 10 and a surface layer 20 from a single material as in the above-described first and second embodiments.

The crosslinkable resin is a liquid resin having a viscosity characteristic that can especially trap a gas at the time of heating to form a communication structure. Any one may be used as long as it contains a urethane resin, an epoxy resin, an acrylic resin, or a liquid rubber as a main agent. For example, in isocyanates of a blocked urethane resin, TDI (tolylene diisocyanate) or MDI (methylene diphenyl diisocyanate) is preferable in order to form an internal cell having a high effect to absorb sound. TDI is more preferable.

In addition, a molecular weight of the blocked urethane resin preferably has a weight average molecular weight Mw of 1000 to 30000, more preferably 10000 to 20000 in order to effectively trap the foaming gas therein. If the molecular weight is below 1000, the gas cannot be trapped at the time of curing. On the other hand, if it is over 30000, a structure having a high effect to absorb sound cannot be obtained. An additive amount thereof is 5 percent by weight to 90 percent by weight, more preferably 10 percent by weight to 50 percent by weight.

When the water is used as a foaming agent with a two-pack urethane, for example, when it is used in a drying line of an automobile coating factory, the water volatilizes before the urethane is cured. Consequently, it is necessary to add the foaming agent. As the foaming agent, an organic foaming agent, an inorganic foaming agent, microcapsules, a hydrated inorganic filler (water is released at a high temperature) or the like may be used.

In addition, an organic decomposition type foaming agent such as ADCA (azodicarbonamide) and OBSH (oxybis benzene sulfonyl hydrazide) or an inorganic decomposition type foaming agent such as sodium hydrogen carbonate may be used alone or in combination. In case of OBSH, a weight ratio thereof relative to a urethane resin is preferably 3% to 30%, more preferably 5% to 20%. A foaming aid may preferably be added as needed. For example, a metallic salt such as urea, zinc oxide, magnesium oxide, zinc stearate, barium stearate, dibasic phosphate, and lead oxide, a vulcanization accelerator such as a dimethyldithiocarbamic acid, a long-chain alkyl acid such as a stearic acid and an oleic acid, or an organic amine such as diethanolamine and dicyclohexylamine may be added in an amount of 10% to 100% relative to an amount of the foaming agent.

An added substance arbitrarily selected from a curing agent, a solvent such as a plasticizer and a filler may be further incorporated. For example, the curing agent includes one (thermal crosslinking, nonreactive type at room temperature) that is adaptable to a main agent such as an amine and a sulfur. The filler includes calcium carbonate, calcium oxide, talc, mica, Wollast, graphite or the like. As the solvent such as a plasticizer, a resin such as PVC powder and acrylic powder for assisting physical properties of a film may be also added. Moreover, as other resin, a stabilizer, a water absorbing material, a flame retardant, a corrosion inhibitor, a plasticizer or the like may be also added.

As described above, even in a structure having a sound absorption characteristic of the third embodiment, a resonance structure is constructed of microscopic pores (corresponding to 21 of FIG. 1) formed on the surface 20A, communicating passages (corresponding to 22 of FIG. 1) communicating with the microscopic pores (corresponding to 21 of FIG. 1) and sound pores of a plurality kinds of volumes (corresponding to 14 of FIG. 1) that are formed at an inner part deeper than the surface (corresponding to 20A of FIG. 1) having the microscopic pores (corresponding to 21 of FIG. 1) formed, that communicate with the communicating passage (corresponding to 22 of FIG. 1) and that have a volume formed larger than volumes of the microscopic pore (corresponding to 21 of FIG. 1) formed on the surface (corresponding to 20A of FIG. 1) and the communicating passage (corresponding to 22 of FIG. 1) as in the structure having the sound absorption characteristic shown in the first and second embodiments. A value of a flow resistance of the air at the surface (corresponding to 20A of FIG. 1) is increased, and a flow resistance of the air in the sound pore (corresponding to 14 of FIG. 1) formed at the inner part deeper than the surface (corresponding to 20A of FIG. 1) is lowered.

[Summary of the Embodiments]

In conclusion, the structure 1 having the sound absorption characteristic of the present embodiment of the invention includes the surface layer 20 having the microscopic pores 21 formed on the surface 20A, the communicating passages 24 communicating with the microscopic pores 21 and the sound pores 14 of the porous layer 10 that are formed at the inner part deeper than the surface layer 20 and that have a volume larger than volumes of the microscopic pore 21 and the communicating passage 24. A part of the sound pores 14 communicates with the microscopic pore 21 through the communicating passage 24. The sound absorption characteristic and/or the sound insulation characteristic is provided by the microscopic pores 21 of the surface layer 20, the communicating passages 24 and the sound pores 14. Such structure 1 having the sound absorption characteristic is formed of the foamable synthetic resin composition.

Accordingly, the structure 1 having the sound absorption characteristic has sound absorption characteristics by: a sound absorbing mechanism in which sound absorption is performed by space resonance by an air resistance that increases the flow resistance (ventilation resistance) of the air passing through the surface layer 20 and that weakens the flow resistance of the air flowing inside the structure 1 having the sound absorption characteristic; a sound absorbing mechanism by resonance of a surface layer provided by the surface layer 20 and the sound pores 14 extending below thereof; and a sound absorption mechanism by resonance of the porous layer 10 forming the sound pores 14. It enables a sound absorption control over a wide frequency band. In the present embodiment, as shown in FIG. 4, the sound absorption characteristics serve from a low frequency of 500 Hz or less to a high frequency of 5000 Hz or more. Thus, a favorable sound absorption characteristic can be obtained in a relatively wide range of audible frequencies of the human being over around 1000 Hz. In addition, the sound pores 14 of the porous layer 10 are provided such that the sound pores 14 partially communicate with each other and a part of the sound pores 14 is further connected to the microscopic pore 21 through the communicating passage 22. Thus, if a noise is propagated to the structure 1 having the sound absorption characteristic, the sound is propagated from the microscopic pore 21 to the communicating passage 22 and from the communicating passage 22 to the sound pore 14. At this time, the sound is absorbed by resonance. Here, the sound pore 14 is further connected to the sound pore 14 inside the structure 1 having the sound absorption characteristic through the communicating passage 16.

Consequently, the sound is further propagated to the inside and the sound absorption by resonance is further performed. In addition, the sound absorption characteristics can be provided up to a low frequency, since the sound pores 14 communicate with each other. Consequently, a volume of the sound pore 14 leading to the communicating passage 22 increases. Thus, the noise propagated to the microscopic pores 21 of the structure 1 having the sound absorption characteristic is hardly propagated from the microscopic pores 21 to the outside of the structure 1 having the sound absorption characteristic. Moreover, a favorable sound absorption characteristic is shown in a wide range of frequencies.

As described above, the present invention is described in accordance with the above-described embodiments. However, the present invention is not limited only to the above-described operation modes and various modes according to a principle of the present invention are embraced therein.

The invention claimed is:

1. A structure having a sound absorption characteristic comprising:

a surface layer having microscopic pores formed on a part of a surface, communicating passages communicating with the microscopic pores, and sound pores of a porous layer that are formed at an inner part deeper than the surface layer and that have a volume larger than volumes of the microscopic pore and the communicating passage, wherein the surface layer, the communicating passages, and the sound pores are provided on a portion where at least one of a sound absorption characteristic and a sound insulation characteristic that is desired, wherein a part of the sound pores communicates with the microscopic pore through the communicating passage, while another part of the sound pores forms closed spaces by being connected to the surface layer, and wherein the structure is formed by coating and foaming a foamable synthetic resin composition, which provides at least one of the sound absorption characteristic and/or the sound insulation characteristic by the microscopic pores of the surface layer, the communicating passages, the sound pores, and the surface layer which is in contact with the sound pores, on the portion where at least one of the sound absorption characteristic and the sound insulation characteristic is desired.

2. A structure having a sound absorption characteristic according to claim 1, wherein at least one of the sound absorption characteristic and the sound insulation characteristic provided by the microscopic pores of the surface layer, the communicating passages, the sound pores and the surface layer that contact the sound pores is such that the microscopic pores have an area ratio of pores to the surface at 0.1% to 10% to provide a sound absorption characteristic in a frequency band including at least 1000 Hz in an audible frequency range of a human being by a resonance in spaces communicating from the microscopic pores to the sound pores and a film resonance by the surface layer, the microscopic pores thereof and the sound pores.

3. A structure having a sound absorption characteristic according to claim 1, wherein a density of the surface layer is higher than a density of the porous layer.

* * * * *